US006702171B2

(12) United States Patent
Büchel et al.

(10) Patent No.: US 6,702,171 B2
(45) Date of Patent: Mar. 9, 2004

(54) SETTING TOOL

(75) Inventors: Johann Büchel, Sevelen (CH); Norbert Welte, Klaus (AT); Norbert Wohlwend, Nendeln (LI)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/072,718

(22) Filed: Feb. 6, 2002

(65) Prior Publication Data

US 2002/0125291 A1 Sep. 12, 2002

(30) Foreign Application Priority Data

Feb. 6, 2001 (DE) ..... 101 05 196

(51) Int. Cl.[7] ..... B25C 1/00
(52) U.S. Cl. ..... 227/9; 227/10
(58) Field of Search ..... 227/9; 1/10

(56) References Cited

U.S. PATENT DOCUMENTS 4,332,340 A * 6/1982 Harris ..... 227/10
4,898,315 A * 2/1990 Vernerey ..... 227/10
5,114,064 A * 5/1992 Jochum et al. ..... 227/9
5,332,140 A * 7/1994 Almeras et al. ..... 227/9
5,950,900 A * 9/1999 Frommelt et al. ..... 227/9
6,059,163 A * 5/2000 Pfister et al. ..... 227/10
6,123,242 A * 9/2000 Kersten ..... 227/10
6,126,055 A * 10/2000 Gantner et al. ..... 227/10
6,220,495 B1 * 4/2001 Jakob ..... 227/10

* cited by examiner

*Primary Examiner*—Rinaldi I. Rada
*Assistant Examiner*—Gloria R Weeks
(74) *Attorney, Agent, or Firm*—Sidley Austin Brown & Wood, LLP

(57) ABSTRACT

A setting tool is formed of a housing (1) and an axially displaceable bolt guide (8) situated in and extending out of the leading end of the housing. A protective cap (5) is detachably arranged on the leading end region of the housing (1) and prevents abrasion of the housing (1) under conditions prevailing at the construction site and thus prevents wear on the housing (1).

5 Claims, 2 Drawing Sheets

SETTING TOOL

FIELD OF THE INVENTION

Figure 1:
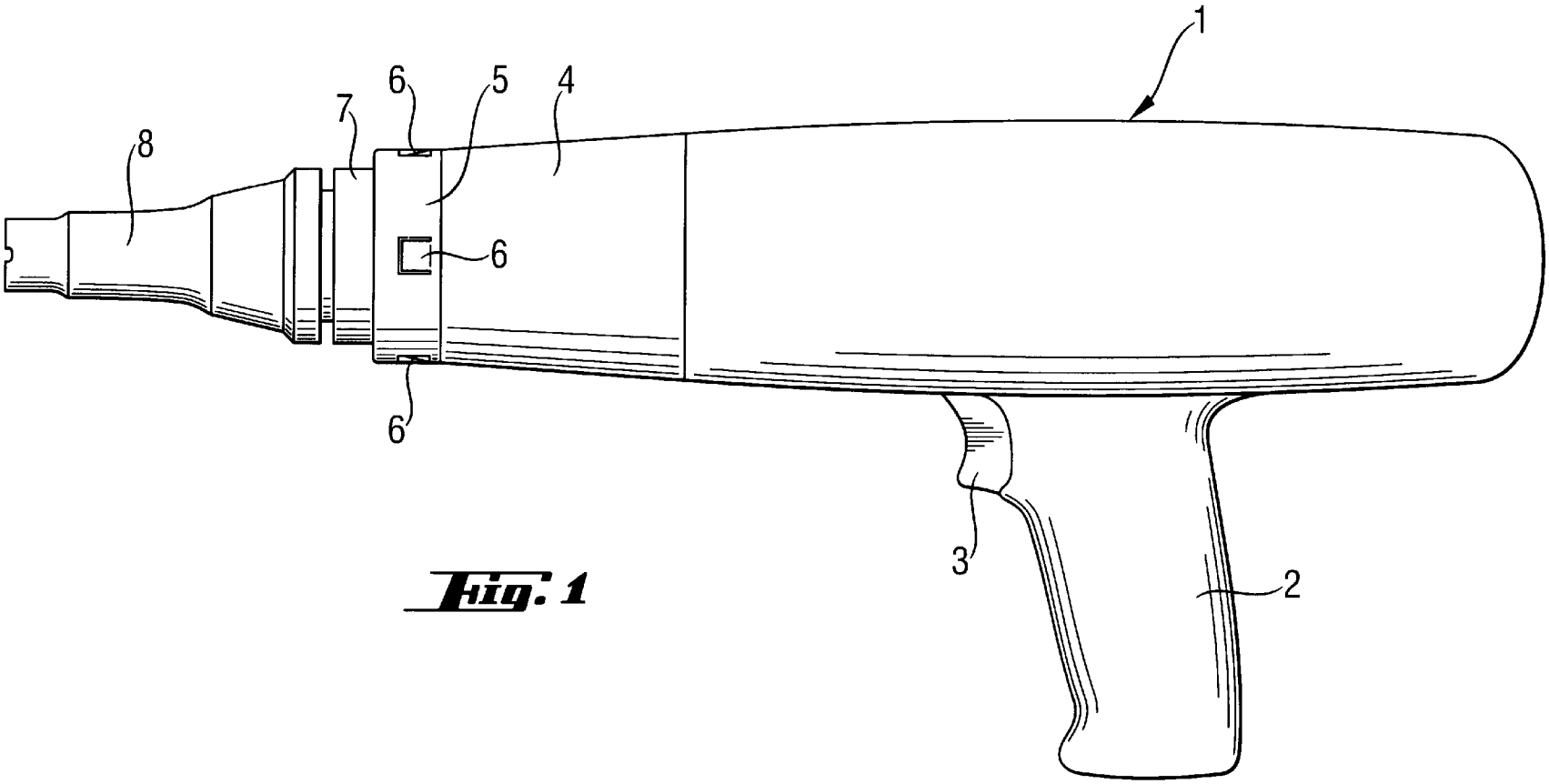

The invention relates to a setting tool with a protection cap formed on the leading end of the tool housing.

BACKGROUND OF THE INVENTION

In explosive powder actuated or gas actuated setting tools, plastic materials are being used on an increasing basis, in particular in the housings. Parts fashioned out of plastic have fundamental advantages with respect to mass manufacturing, production costs, design and damping.

Accessibility to various fastening locations that, for example, are located in corners, in proximity to sharp edges or between reinforcing steel is frequently so limited that the area of the housing at its setting end abrades and wears down under building site environment conditions. The housing is further damaged by impact, percussion and tears. Parts situated on the inside of the housing and essential to the operation of the setting tool can, for example, lose their support as a result of such damage and consequently fail to fulfill their respective functions.

SUMMARY OF THE INVENTION

The primary object of the invention is to provide a setting tool that can be used even in corners, near sharp edges or between reinforcing steel characterized in that particularly the leading, setting end of the housing is not damaged or worn down.

According to the invention the object is achieved in that an end zone of the housing on the setting-side is surrounded by a protective cap.

The protective cap according to the invention protects the housing on the front or setting end from wear and impact under the conditions prevailing at the building site.

In order to achieve protection of the greatest possible area of the housing, the protective cap preferably extends over at least a part of the periphery of the housing.

Several bearing points inside of the housing provide for axial displaceability of the bolt guide and extend in part up to the front at the setting end of the housing. To prevent damage to bearing points, the protective cap extends preferably over a portion of the front face of the housing on the setting end.

Wear phenomena cannot be completely eliminated even in the case of the protective cap; therefore, from time to time, the protective cap must also be replaced. To allow such replacement to be carried out easily, the protective cap can be conveniently removably fastened to the housing.

Rapid fastening of the protective cap to the housing is preferably achieved using an essentially radially displaceable fixation means that works together form-fittingly with a corresponding recess in the outside surface of the housing. The fixation means, for example, can be a short threaded pin that is accommodated in a threaded hole in the protective cap and extending into a corresponding matching recess on the outside surface of the housing. For example, a plurality of recesses can be arranged in a single plane and in intervals from one another on the periphery of the housing. It is also possible to arrange the protective cap axially fixedly on the housing but rotatably with respect to the housing. In this case it is, however, necessary that the recess into which at least one fixation means projects, is designed to be circumferentially extending.

The creation of a one-piece protective cap is achieved in that the fixation means is preferably comprised of a radially spring biased, die-cut tab of the protective cap.

In order to achieve a particularly long service life of the inventive protective cap, the material out of which the protective cap is manufactured has a toughness that is appropriately greater than that of the material out of which the housing is formed.

For reasons connected with production engineering and strength, the protective cap is advantageously made of a metal.

BRIEF DESCRIPTION OF THE INVENTION

Figure 2:
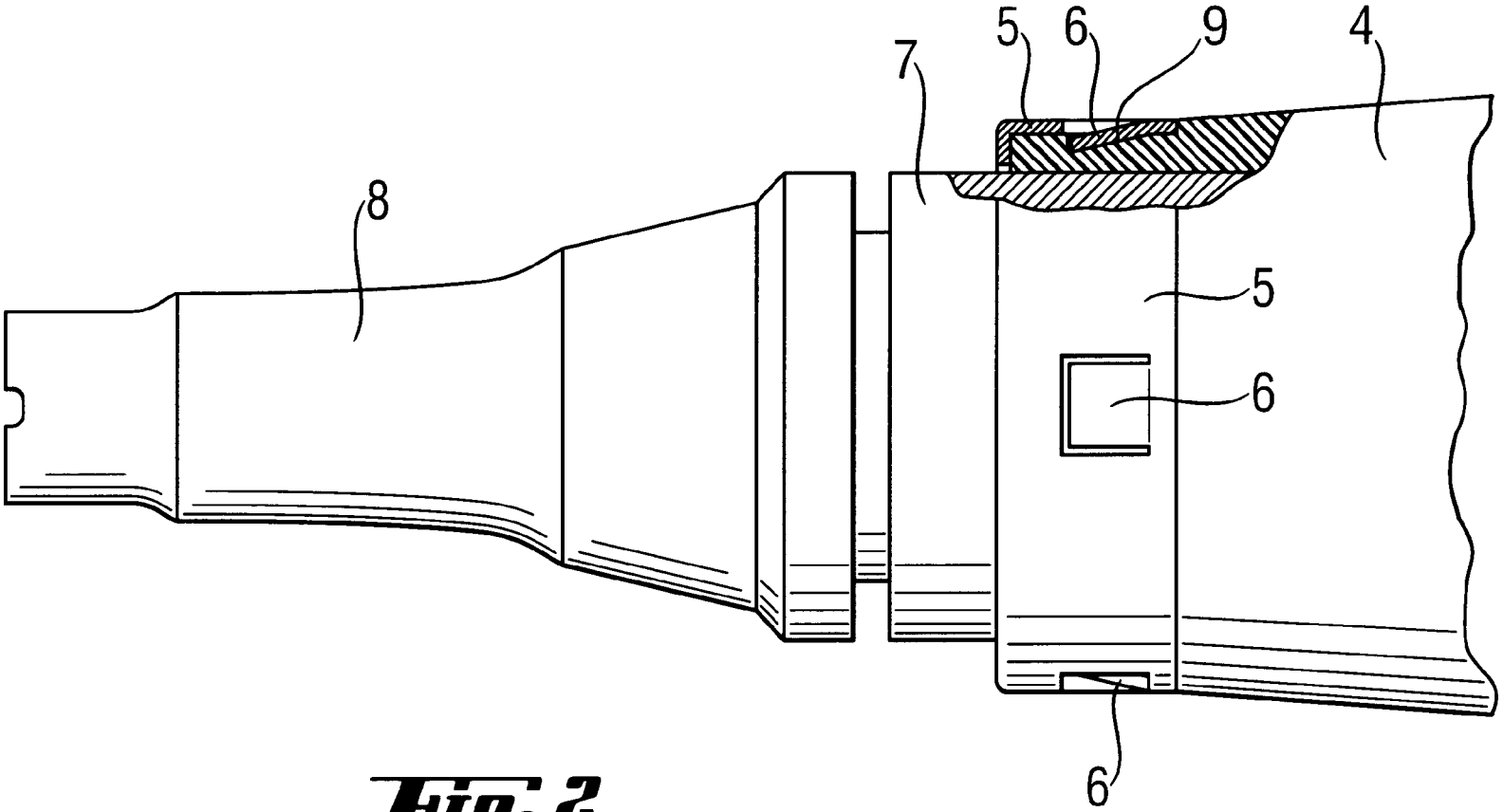

The invention is more completely described read together with the following illustrations of an exemplary embodiment, wherein FIG. 1 is an overall side view of the setting tool disclosed in the invention; and FIG. 2 depicts the partial cut away view of the leading end of the setting tool and the bolt guide.

DETAILED DESCRIPTION OF THE INVENTION

The setting tool illustrated in FIG. 1 has a housing 1 which is, for example, made of plastic, a handle 2 that projects laterally from adjacent the trailing end of housing 1, an actuation switch or trigger in the handle 3, a protective cap 5 and a bolt guide 8. The trigger 3 is located facing in the setting direction from the handle 2, that is, in the transitional area between the housing 1 and the handle 2.

The front region of the housing 1 facing in the setting or driving direction is comprised of an interlocking sleeve 4 that is connected to the rest of the housing 1 by a threaded connection (not shown in the drawing). The bolt guide 8 is similarly connected to a piston guide (also not shown in the illustration) which is accommodated on the inside of the housing 1 and is axially displaceable with respect to the housing 1. The free, setting end of the housing 1 that is adjacent to the interlocking sleeve 4 is formed by a guide sleeve 7 mounted in the remaining part of the housing 1. The end zone formed by the interlocking sleeve 4 on the setting-side is covered by the protective cap 5 which extends around the entire circumference of the housing 1.

Axial fixation of the protective cap 5 to the outside surface of the interlocking sleeve 4 is achieved by means of a plurality of radially spring biased, die-cut tab fixation means 6 which project into the correspondingly formed recesses 9 in the outside surface of the interlocking sleeve 7. Instead of a plurality of individual recesses 9, a circumferential recess 9 can be provided, which allows rotation of the protective cap 5 with respect to the housing 1. For example, the protective cap 5 is constructed of a metal that has greater toughness than that of the plastic comprising at least the interlocking sleeve 4 of the housing 1.

What is claimed is:

1. A setting tool comprising a housing (1) made of a plastic material and forming an exterior surface of said setting tool and having a leading end and a trailing end, an axially displaceable bolt guide (8) mounted in and projecting outwardly from the leading end of said housing, said housing having a protective cap (5) adjacent the leading end thereof covering the plastic material of said housing (1) and formed of a material having a greater toughness than said plastic material forming the housing (1), said protective cap (5) being removably fixed to the housing (1), and a substantially radially displaceable fixation means (6) securing the protective cap (5) to said housing (1) and being interlocked in a form-fitting manner in a recess (9) in an outside surface of said housing.

2. A setting tool, as set forth in claim 1, wherein said protective cap (5) extends over at least a portion of the circumference of said housing (1).

3. A setting tool, as set forth in claim 1 wherein said protective cap (5) extends over a portion of the leading end of said housing (1).

4. A setting tool, as set forth in claim 1 wherein said fixation means comprises a radially spring biased die-cut tab formed in said protective cap (5).

5. A setting tool, as set forth in claim 1, wherein the material of said protective cap (5) is a metal.

* * * * *